US005813777A

United States Patent [19]

Bonnstauffer

[11] Patent Number: 5,813,777

[45] Date of Patent: Sep. 29, 1998

[54] STRESS RELIEVING KEYS

[76] Inventor: Bill Bonnstauffer, 27 Eldridge Ave., Staten Island, N.Y. 10302

[21] Appl. No.: 854,259

[22] Filed: May 9, 1997

[51] Int. Cl.[6] ..... B41J 5/12

[52] U.S. Cl. ..... 400/491; 400/490

[58] Field of Search ..... 400/491, 491.1, 400/490

[56] References Cited

U.S. PATENT DOCUMENTS

| | | | |
|---|---|---|---|
| D. 345,152 | 3/1994 | Mermod, Jr. | D14/115 |
| D. 360,629 | 7/1995 | Ho | D14/115 |
| 3,592,979 | 7/1971 | Redman | 200/1 R |
| 4,997,998 | 3/1991 | Bauer | 200/345 |
| 5,152,392 | 10/1992 | Iwasa | 200/517 |
| 5,219,067 | 6/1993 | Lima et al. | 200/302.2 |
| 5,298,706 | 3/1994 | English et al. | 200/517 |
| 5,391,006 | 2/1995 | Danziger | 400/488 |
| 5,410,333 | 4/1995 | Conway | 345/169 |
| 5,476,491 | 12/1995 | Mayn | 607/111 |
| 5,638,831 | 6/1997 | Brown | 128/898 |
| 5,642,109 | 6/1997 | Crowley | 341/22 |
| 5,667,319 | 9/1997 | Satloff | 400/472 |

FOREIGN PATENT DOCUMENTS 9533394 12/1995 WIPO .

*Primary Examiner*—Edgar S. Burr
*Assistant Examiner*—Leslie Grohusky

[57] ABSTRACT

A cushioned key including a top face, a bottom face, and four side faces. Each key has a hollow cushion compartment defined by the top face of the key, the side faces of the key and further a divider.

16 Claims, 1 Drawing Sheet

STRESS RELIEVING KEYS

BACKGROUND OF THE INVENTION

1. Field of the Invention

The present invention relates to a stress relieving key system and more particularly pertains to reducing the stress associated with the repeated depression of resilient keys.

2. Description of the Prior Art

The use of padded keys is known in the prior art. More specifically, padded keys heretofore devised and utilized for the purpose of relieving stress associated with the repetitive depression of keys are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,290,115 to Little; U.S. Pat. No. 5,298,706 to English et al.; U.S. Pat. Des. 345,152 to Mermond, Jr.; U.S. Pat. Des. 360,629 to Ho; U.S. Pat. No. 5,410,333 to Conway; and U.S. Pat. No. 5,391,006 to Danzigr.

In this respect, the stress relieving key system according to the present invention substantially departs from the conventional concepts and designs of the prior art, and in so doing provides an apparatus primarily developed for the purpose of reducing the stress associated with the repeated depression of resilient keys.

Therefore, it can be appreciated that there exists a continuing need for a new and improved stress relieving key system which can be used for reducing the stress associated with the repeated depression of resilient keys. In this regard, the present invention substantially fulfills this need.

SUMMARY OF THE INVENTION

In view of the foregoing disadvantages inherent in the known types of padded keys now present in the prior art, the present invention provides an improved stress relieving key system. As such, the general purpose of the present invention, which will be described subsequently in greater detail, is to provide a new and improved stress relieving key system which has all the advantages of the prior art and none of the disadvantages.

To attain this, the present invention essentially comprises a keyboard and a plurality of keys situated on a top face thereof. As shown in FIG. 2, each key has a square generally planar top face, a bottom face, and four side faces having outer surfaces that are bevelled outwardly from the top face to the bottom face of the associated key. Each key has a generally trapezoidal cross-section. A top hollow cushion compartment with a square configuration is formed within each key. Note FIG. 3. The cushion compartment is defined by the top face of the key, the side faces of the key and further a divider. Such divider resides in parallel relationship with the top face of the key. Further, the divider is formed in communication with each side edge to entirely enclose the cushion compartment. Each key further has an engagement compartment defined by the divider and inner surfaces of each of the side faces of the key. The inner surfaces of each side face of the key have an upper extent with walls that are bevelled outwardly from top to bottom. Situated below the upper extent is a lower extent with walls that are bevelled inwardly from top to bottom. The upper extent has a height that is at least four times that of the lower extent. As shown in FIG. 3, the engagement compartment has a square bottom opening for allowing access therein. Finally, a deformable cushion gel is situated within the cushioning compartment. In the preferred embodiment, the gel comprises silicone.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stress relieving key system which has all the advantages of the prior art padded keys and none of the disadvantages.

It is another object of the present invention to provide a new and improved stress relieving key system which may be easily and efficiently manufactured and marketed.

It is a further object of the present invention to provide a new and improved stress relieving key system which is of a durable and reliable construction.

An even further object of the present invention is to provide a new and improved stress relieving key system which is susceptible of a low cost of manufacture with regard to both materials and labor, and which accordingly is then susceptible of low prices of sale to the consuming public, thereby making such stress relieving key system economically available to the buying public.

Still yet another object of the present invention is to provide a new and improved stress relieving key system which provides in the apparatuses and methods of the prior art some of the advantages thereof, while simultaneously overcoming some of the disadvantages normally associated therewith.

Still another object of the present invention is to reduce the stress associated with the repeated depression of resilient keys.

Lastly, it is an object of the present invention to provide a new and improved cushioned key including a top face, a bottom face, and four side faces. Each key has a hollow cushion compartment defined by the top face of the key, the side faces of the key and further a divider.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
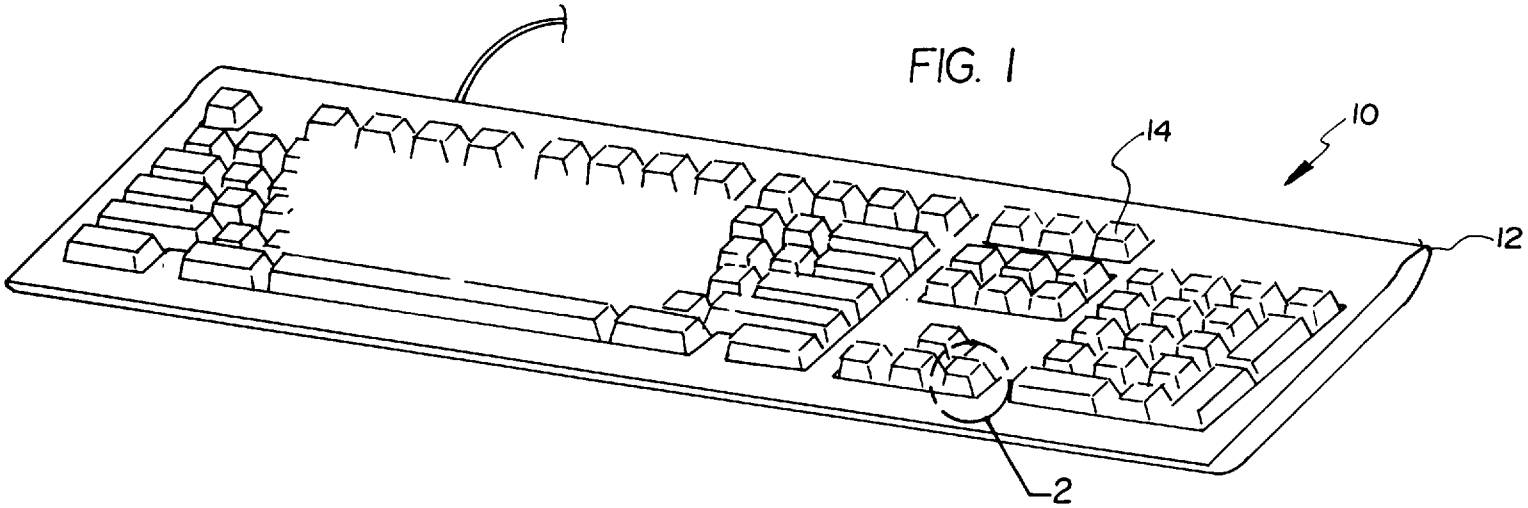
FIG. 1 is a perspective illustration of the preferred embodiment of the stress relieving key system constructed in accordance with the principles of the present invention.

With reference now to the drawings, and in particular to FIG. 1 thereof, a new and improved stress relieving key system embodying the principles and concepts of the present invention and generally designated by the reference numeral 10 will be described.

The present invention, the new and improved stress relieving key system, is comprised of a plurality of components. Such components in their broadest context include a keyboard and a plurality of keys with hollow cushion compartments with gel maintained therein. Such components are individually configured and correlated with respect to each other so as to attain the desired objective.

Figure 2:
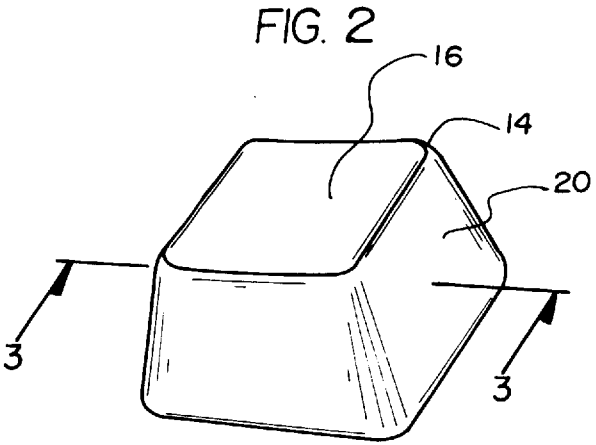
FIG. 2 is a perspective close up view of the outer surface of one of the keys of the present invention.

More specifically, it will be noted that the system 10 of the present invention includes a keyboard 12 and a plurality of keys 14 situated on a top face thereof. As shown in FIG. 2, each key has a square generally planar top face 16, a bottom face 18, and four side faces 20 having outer surfaces that are bevelled outwardly from the top face to the bottom face of the associated key. Each key has a generally trapezoidal cross-section. Ideally, each key has a height of approximately 5/16 of an inch, a length of approximately 9/16 of an inch, and a width of approximately 9/16 of an inch.

Also included is a top cushion compartment 22 with a square configuration with a hollow imperforate container formed within each key. Note FIG. 3. The cushion compartment is defined by the top face of the key, the side faces of the key and further a divider 24. Such divider resides in parallel relationship with the top face of the key. Further, the divider is formed in communication with each side edge to entirely enclose the cushion compartment. It is imperative that the key be constructed from a deformable elastomeric material and further that the top face be of a specific thickness. This is important so that the top face may collapse in response to pressure applied thereto by a finger. Preferably, the thickness of the top face is less than 1/3 the thickness of the side walls. Further, it is preferred that the thickness of the compartment be at least equal to the thickness of the side walls.

Figure 3:
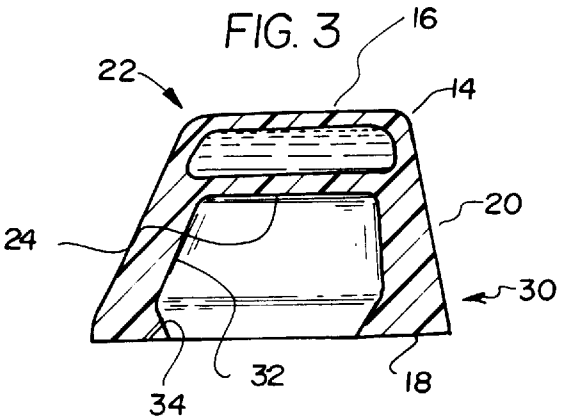
FIG. 3 is a cross-sectional view of the present invention taken along line 3—3 shown in FIG. 2.

Each key further has an engagement compartment 30 defined by the divider and inner surfaces of each of the side faces of the key. The divider ideally has a thickness equal to that of the top face. The inner surfaces of each side face of the key have an upper extent 32 with walls that are bevelled outwardly from top to bottom. Situated below the upper extent is a lower extent 34 with walls that are bevelled inwardly from top to bottom. The upper extent has a height that is at least four times that of the lower extent. As shown in FIG. 3, the engagement compartment has a square bottom opening for allowing access therein. It should be noted that the engagement portion is specially adapted to engage a standard key locking mechanism.

Finally, a deformable cushion gel is situated and enclosed within the cushioning compartment. In the preferred embodiment, the gel comprises of silicone.

The present invention thus provides an improved design for computer keyboard keys that is adapted for reducing the stress associated with the repeated depression of resilient keys. By this design, detrimental effects of Carpel Tunnel Syndrome are abated. It should be noted that the concepts disclosed herein are just as applicable to other device wherein keys are repeatedly depressed. Examples of such devices include pianos, cash registers, adding machines, and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. A new and improved stress relieving key system comprising:

a keyboard;

a plurality of keys situated on a top face of the keyboard, each key having a square generally planar top face, a bottom face, and four side faces having outer surfaces that are bevelled outwardly from the top face to the bottom face of the associated key, each key having a generally trapezoidal cross-section, each key having a top hollow cushion compartment with a square configuration, the cushion compartment defined by the top face of the key, the side faces of the key and further a divider, the divider being in parallel relationship with the top face of the key and in communication with each side edge to entirely enclose the cushion compartment, each key further having an engagement compartment defined by the divider and inner surfaces of each of the side faces of the key, the inner surfaces of each side face of the key having an upper extent with walls that are bevelled outwardly from top to bottom and a lower extent with walls that are bevelled inwardly from top to bottom, the upper extent having a height that is at least four times that of the lower extent, the engagement compartment having a square bottom opening for allowing access therein; and a deformable cushion gel situated within the cushioning compartment, wherein the gel comprises silicone.

2. A cushioned key comprising a one-piece member including a top face, a bottom face, four side faces, and a divider, each key having a hollow imperforate cushion compartment defined by the top face of the key, the side faces of the key and the divider; and a deformable cushion gel comprising material different from that which the top face, bottom face, and divider are constructed, the cushion gel situated within the cushion compartment.

3. A cushioned key as set forth in claim 2 wherein the divider is in parallel relationship with the top face of the key and in communication with each side edge to entirely enclose the cushion compartment.

4. A cushioned key as set forth in claim 2 wherein each key further has an engagement compartment defined by the divider and inner surfaces of each of the side faces of the key.

5. A key according to claim 2 wherein the key is a user interface key of a cash register.

6. A key according to claim 2 wherein the key is a user interface key of a piano.

7. A key according to claim 2 wherein the key is a user interface key of an adding machine.

8. A one-piece key comprising a first top compartment, a second bottom compartment, and a divider separating said first and second compartments, wherein the divider comprises a deformable material, wherein the second compartment is hollow, and wherein the first compartment is imperforate and contains an enclosed gel composition.

9. A key according to claim 8 wherein the key is a user interface key of a cash register.

10. A key according to claim 8 wherein the key is a user interface key of a piano.

11. A key according to claim 8 wherein the key is a user interface key of an adding machine.

12. A key according to claim 8 wherein the divider is in parallel relationship between the first and second compartments.

13. A key according to claim 8 wherein said gel composition comprises silicone.

14. A stress relieving key system comprising a keyboard and a one-piece key situated on the keyboard, wherein said key comprises a first top compartment, a second bottom compartment, and a divider separating said first and second compartments, wherein the divider comprises a deformable material, wherein the second compartment is hollow, and wherein the first compartment is imperforate and contains an enclosed gel composition.

15. A stress relieving key system according to claim 14 wherein the gel composition comprises silicone.

16. A stress relieving key system according to claim 14 wherein the divider is in parallel relationship between the first and second compartments.

* * * * *